United States Patent [19]

Jameson

[11] 4,136,494

[45] Jan. 30, 1979

[54] TRIANGLE CHAIN ANCHOR

[76] Inventor: Robert W. Jameson, 1690 Nutwood Rd., Akron, Ohio 44305

[21] Appl. No.: 899,536

[22] Filed: Apr. 24, 1978

[51] Int. Cl.[2] ..... E02D 5/74

[52] U.S. Cl. ..... 52/166; 248/119 R

[58] Field of Search ..... 52/166, 162, 704, DIG. 11, 52/707, 708, 298; 24/116 R; 248/119 R

[56] References Cited

U.S. PATENT DOCUMENTS

| | | | |
|---|---|---|---|
| 2,623,255 | 12/1952 | Thomsen | 24/116 R |
| 3,425,174 | 2/1969 | Wood | 52/166 X |
| 3,872,797 | 3/1975 | Baker et al. | 248/119 R |
| 3,908,961 | 9/1975 | Hicks | 52/DIG. 11 |
| 3,990,207 | 11/1976 | Eck et al. | 52/166 X |
| 4,020,630 | 5/1977 | DeShetler | 24/116 R |
| 4,044,691 | 8/1977 | Kilgus | 248/119 R |
| 4,070,834 | 1/1978 | Jameson | 52/166 |

*Primary Examiner*—J. Karl Bell

*Attorney, Agent, or Firm*—Oldham, Oldham, Hudak & Weber Co.

[57] ABSTRACT

An anchor assembly includes an elongate base means that has a tie-down member for operatively engaging the back end of the base means to attach it to a support, a brace member operatively engages the base means and extends upwardly thereof so that a flexible stress member can operatively engage and extend between a back end of the base means, an upper end of the brace member and the front end of the base means so that a second stress cable or chain to be anchored can engage the first stress member intermediate the upper end of the brace means and the front portion of the base means to extend therefrom to engage the work object.

5 Claims, 5 Drawing Figures

TRIANGLE CHAIN ANCHOR

BACKGROUND OF INVENTION

Heretofore I have done appreciable development work in relation to anchor means for stress producing articles, chains and cables such as are used in automobile body and fender straightening and processing or working operations. Accordingly, I have been issued U.S. Pat. No. 4,070,834 upon an anchor device that I have developed for engaging a floor support surface for having a stress carrying chain member extend therefrom to engage the work object. However, it has developed that a further anchor means is required in relation to my previous anchor device, which normally was positioned substantially flush with the surface of the support floor, so as to elevate the stress producing chain or cable to a workable distance from the floor and yet to permit the stress chain or member to extend substantially parallel to the floor surface for work operations and use.

Accordingly, it is the general object of the present invention to provide an improved anchor assembly for flexible stress cables, chains or the like and to form such anchor assembly from sturdy mechanical members relatively readily assembled with each other to have a long and useful work life and to require a minimum of maintenance thereon.

Another object of the invention is to provide an anchor assembly from conventional members of mechanical design that can be inexpensively formed, assembled and used as an anchor assembly for use in automobile body processing shops or other operations requiring substantially horizontally extending stress producing flexible members.

Another object of the invention is to facilitate the provision of high stress cables and chains in small workshops.

Reference now is particularly directed to the accompanying drawings, where:

When referring to corresponding members shown in the drawings and referred to in the specification, corresponding numerals are used to facilitate comparison therebetween.

Figure 1:
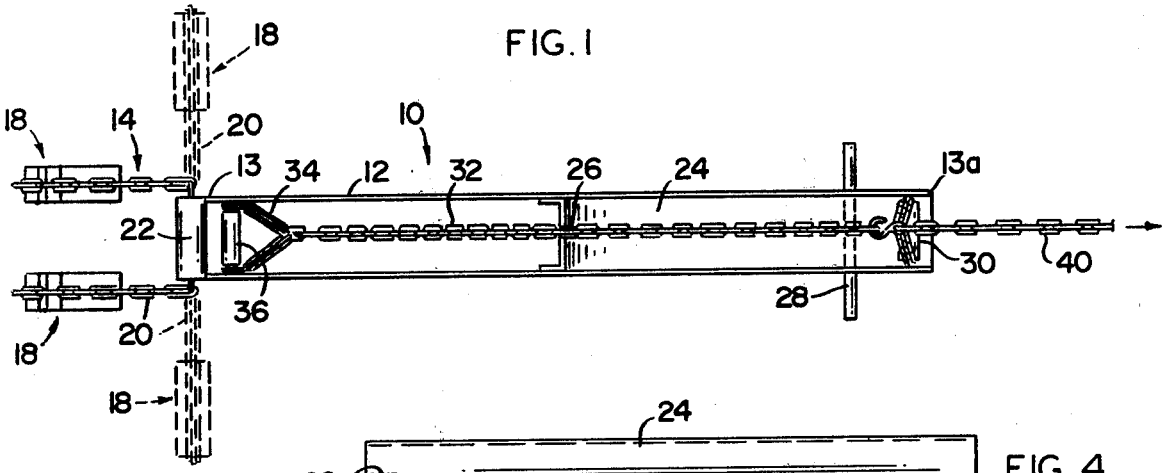
FIG. 1 is a plan view of an anchor assembly embodying the principles of the invention.
Figure 4:
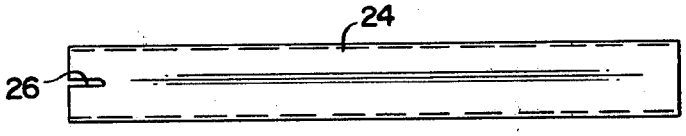
FIG. 4 is a plan of a brace means used in the apparatus of FIG. 1.
Figure 5:
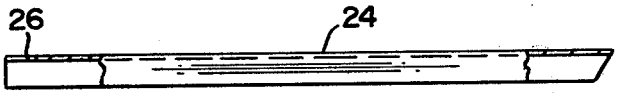
FIG. 5 is a side elevation, partially broken away and shown in vertical section of the brace member of FIG. 4.
Figure 2:
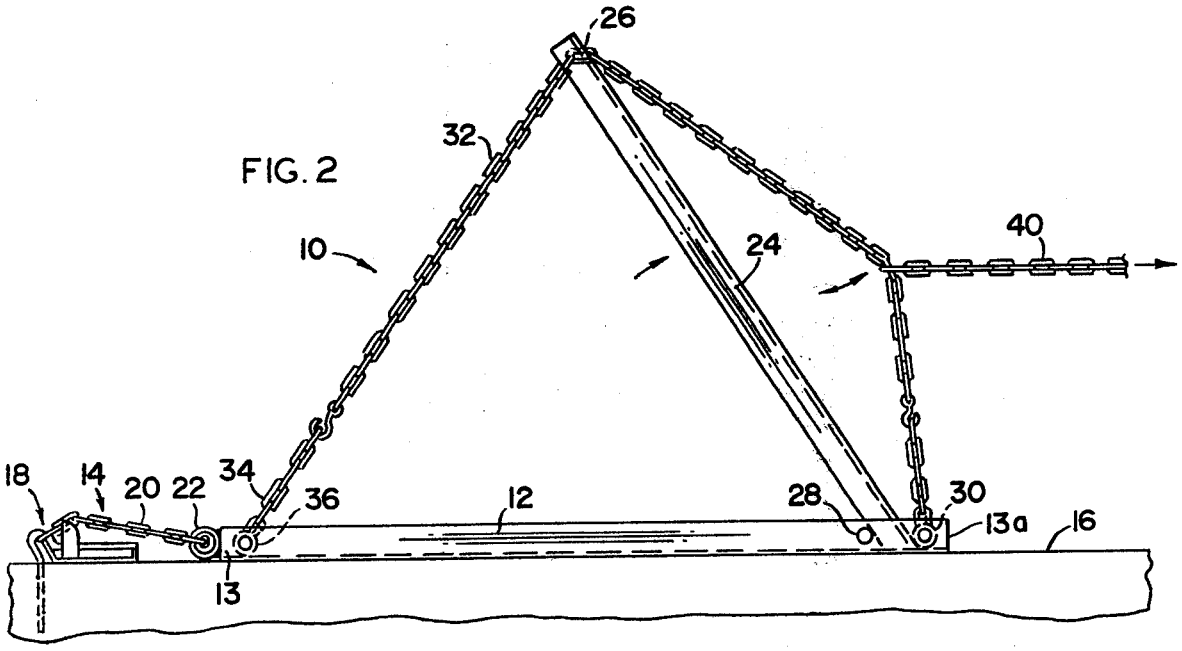
FIG. 2 is a side elevation of the anchor assembly of FIG. 1.
Figure 3:
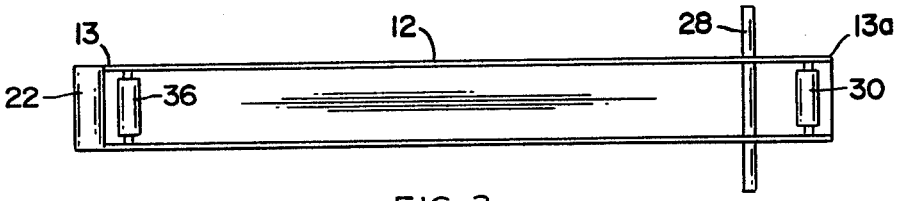
FIG. 3 is a plan view of the base member of the apparatus of FIGS. 1 and 2.

With reference to the details of the construction shown in the accompanying drawings, an anchor assembly is indicated by the number 10. This anchor assembly 10 includes an elongate base means 12. Usually such base means comprises a metal channel that has rear and front ends 13 and 13a and wherein a tie-down means 14 operatively engages the rear end 13 of the base means to secure it to a support surface, such as a floor 16. This tie-down means preferably comprises a pair of anchor devices 18, as shown in and disclosed in my U.S. Pat. No. 4,070,834. These devices 18 are used to anchor a chain member 20 that extends through a tube 22 suitably welded to or otherwise secured to the rear end of the base means 12. These anchors 18 may be secured in the positions shown, or they could be positioned laterally of the base means 12, as indicated in dotted lines, so as to secure this base means tightly to the support surface.

A brace member 24, which may be a metal channel similar to the channel forming the base means 12, is present and it is of such shape and length so as to be received within the upright flanges of the base means 12 and preferably the upper end of this brace is slotted as at 26. The lower end of the brace means usually is cut off at an angle less than a right angle so that it can extend upwardly and rearwardly from the base means 12 when the brace is operatively positioned. The brace means 24 is retained in a given position and will not move longitudinally of the base means by a pair of supports that may comprise a cross rod 28 engaging the base means 12 and a brace tube or rod 30 attached to the base means forwardly of this brace means 24.

So as to complete the anchor assembly for anchoring stresses to be applied thereto, I preferably provide a first flexible stress member, such as a chain 32, which preferably has a double or Y-shaped end 34, the arms of which are operatively engaged with and anchored to a cross means 36 suitably secured to the flanges on the base means 12 adjacent the rear end thereof. Such chain 32 extends straight up to the upper end of the brace means 24 where one of the links of the chain preferably is operably engaged with the slot 26 and then such chain 32 extends loosely down to engage the front end of the base means as by being attached to the brace rod 30.

Stress actually is applied to the anchor assembly of the invention by a second flexible stress member, which may comprise a cable or chain 40 that operatively engages the section of the first flexible stress chain 32 that extends between the front of the base means 12 and the upper end of the brace means 24 so as to pull such first flexible stress chain tightly and probably pivot the brace means 24 forward slightly. This action provides appreciable stress on the base means 12, some of which is just forcing it down into further or better engagement with the floor 16, and other stress portions are trying to lift up the rear end 13 of the base means. But, the novel anchors 18 and associated means will retain such rear end of the base means in position.

Usually, this flexible stress member or chain 40 will extend substantially horizontally and the other end thereof, not shown, would engage with any suitable stress producing means or article to be anchored, such as a work piece or frame means of an automobile that may be having other operative stresses or forces applied thereto at another portion thereof.

By the invention, an anchor assembly has been provided for attaching a substantially horizontally extending flexible stress member, such as a cable or chain or the like to an anchor unit and wherein the stresses may be being operably applied at an elevation of several feet above the floor 16 but yet the anchor means will operatively retain the anchor device in a fixed position and permit the application of quite high stresses to and through the second flexible stress member 40. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. An anchor assembly for a flexible stress cable, chain or the like and comprising an elongate base means having front and back ends, a tie-down means operatively engaging the back end of said base means to attach it to a support, a brace member operatively engaging said base means as its front portion thereof and extending upwardly and rearwardly therefrom at an obtuse angle thereto, a first flexible stress member operatively secured to and extending between said back end of said base means, the upper end of said brace member and the front end of said base means, and a second flexible stress member engaging said first flexible stress member intermediate the upper end of said brace member and the front portion of said base means and extending forwardly for attachment to a stressing means which is to be attached to the anchor assembly.

2. An anchor assembly as in claim 1 where means engage said base means and operatively engage said brace member to prevent longitudinal movement of the lower end of said brace member in relation to said base means.

3. An anchor assembly as in claim 1 where said first stress member fixedly engages the upper end of said brace member and said second stress member extends forwardly in operation substantially parallel to said base means which is secured to the floor support surface.

4. An anchor assembly as in claim 1 where said stress members are chains and where said first stress member has Y-shaped ends and where the two arm portions of such ends engage opposite side areas of said base means.

5. An anchor assembly for a stress cable, chain or the like and comprising an elongate base means having front and back ends, a tie-down means for operatively engaging the back end of said base means to attach it to a support, a brace member adapted to operatively engage said base means at its front end and extending upwardly and rearwardly therefrom, and a first flexible stress member adapted to be operatively secured to and extend between said back end of said base means, the upper end of said brace member and the front end of said base means so that a second flexible stress member can engage said first flexible stress member and extend forwardly for attachment to a work object.

* * * * *